US008742682B1

(12) United States Patent
Wang et al.

(10) Patent No.: US 8,742,682 B1
(45) Date of Patent: Jun. 3, 2014

(54) AC DRIVEN LIGHTING SYSTEMS CAPABLE OF AVOIDING DARK ZONE

(71) Applicant: Analog Integrations Corporation, Hsin-Chu (TW)

(72) Inventors: Chang-Yu Wang, Hsin-Chu (TW); Jing-Chyi Wang, Hsin-Chu (TW)

(73) Assignee: Analog Integrations Corporation, Science Park, Hsin-Chu (TW)

( * ) Notice: Subject to any disclaimer, the term of this patent is extended or adjusted under 35 U.S.C. 154(b) by 43 days.

(21) Appl. No.: 13/688,156

(22) Filed: Nov. 28, 2012

(51) Int. Cl.
*H05B 37/02* (2006.01)

(52) U.S. Cl.
USPC ..... 315/291; 315/307; 315/318; 315/185 R; 315/188; 315/294

(58) Field of Classification Search
CPC ..... H05B 33/0815; H05B 41/2828; H05B 33/083; H05B 33/0833; H05B 33/0824; Y02B 20/341; Y02B 20/342
USPC ..... 315/291, 307, 308, 192, 247, 294, 318, 315/185 R, 312, 188
See application file for complete search history.

(56) References Cited

U.S. PATENT DOCUMENTS

| | | | | |
|---|---|---|---|---|
| 8,299,724 | B2 * | 10/2012 | Huynh | 315/291 |
| 8,373,363 | B2 * | 2/2013 | Grajcar | 315/307 |
| 8,384,307 | B2 * | 2/2013 | Grajcar | 315/307 |
| 8,456,095 | B2 * | 6/2013 | Huynh | 315/209 R |
| 8,643,308 | B2 * | 2/2014 | Grajcar | 315/307 |

* cited by examiner

*Primary Examiner* — Haiss Philogene
(74) *Attorney, Agent, or Firm* — Winston Hsu; Scott Margo

(57) ABSTRACT

Disclosed are methods and lighting system with LEDs. An exemplified system comprises series-coupled light-emitting diodes, an integrated circuit, and an energy storage apparatus. The series-coupled light-emitting diodes are divided into several LED groups coupled in series. The integrated circuit comprises nodes respectively coupled to the LED groups, for providing a driving current to selectively flow through at least one of the LED groups. The energy storage apparatus has two ends coupled to a predetermined LED in a predetermined LED group. When the driving current flows through the predetermined LED group the energy storage apparatus energizes; and when the driving current does not flow through the predetermined LED group the energy storage apparatus de-energizes to illuminate the predetermined LED.

20 Claims, 7 Drawing Sheets

AC DRIVEN LIGHTING SYSTEMS CAPABLE OF AVOIDING DARK ZONE

BACKGROUND

The present disclosure relates generally to Light-Emitting Diode (LED) lighting systems and controls; and more particularly to Alternating Current (AC) driven LED lighting systems and controls.

Light-Emitting Diodes or LEDs are increasingly being used for general lighting purposes. In one example, a group of so-called white LEDs is powered from an AC power source and the term "AC LED" is sometimes used to refer to such circuit. Concerns for AC LED include manufacture cost, power efficiency, power factor, flicker, lifespan, etc.

FIG. 1 demonstrates AC LED circuit 10 in the art, which simply has LED module 12 and current-limiting resistor 14. LED module consists of two LED strings connected in anti-parallel. AC LED circuit 10 requires neither an AC-DC converter nor a rectifier. Even though a DC voltage can be supplied, an AC voltage is typically supplied to input port 8 and directly powers AC LED circuit 10. Simplicity in structure and low-price in manufacture are two advantages AC LED circuit 10 has. Nevertheless, AC LED circuit 10 can only shine in a very narrow time period for each AC cycle time, suffering either low average luminance or high-current stress to LEDs.

FIG. 2A demonstrates AC LED circuit 15 in the art. Examples of AC LED circuit 15 can be found in U.S. Pat. No. 7,708,172. AC LED circuit 15 employs full-wave rectifier 18. A DC or AC voltage signal is received on input port 16. A string of LEDs are grouped into LED groups $\mathbf{20}_1$, $\mathbf{20}_2$, $\mathbf{20}_3$, and $\mathbf{20}_4$. Integrated circuit 22 has nodes $PIN_1$, $PIN_2$, $PIN_3$, and $PIN_4$, connected to the cathodes of LED groups $\mathbf{20}_1$, $\mathbf{20}_2$, $\mathbf{20}_3$, and $\mathbf{20}_4$ respectively. Inside integrated circuit 22 are ground switches $SG_1$, $SG_2$, $SG_3$, and $SG_4$, together with controller 24. When the voltage on input port 16 increases, controller 24 can switch ground switches $SG_1$, $SG_2$, $SG_3$, and $SG_4$, to possibly light on more LEDs. Operations of integrated circuit 22 have been exemplified in U.S. Pat. No. 7,708,172 and are omitted here for brevity.

FIG. 2B demonstrates AC LED circuit 30 in the art, whose example can be found in U.S. Pat. No. 8,299,724. Different from integrated circuit 22 in FIG. 2A, integrated circuit 34 in FIG. 2B has an addition node $PIN_0$. Integrated circuit 34 further employs bypass switches $SP_1$, $SP_2$, $SP_3$, and $SP_4$, each selectively providing a bypass current path for driving current to detour a corresponding LED group. For example, when controller 32 turns on bypass switches $SP_1$, nodes $PIN_0$ and $PIN_1$ are shorted together and LED group $\mathbf{20}_1$ darkens because no driving current flows through LED group $\mathbf{20}_1$.

FIG. 3 illustrates the waveforms of signals when input port 16 in FIG. 2A or 2B is supplied with an AC voltage signal. The upmost waveform shows rectified voltage $V_{REC}$, which, as indicated in FIGS. 2A and 2B, refers to the voltage after full-wave rectifier 18 and upon LED group $\mathbf{20}_1$. The second waveform shows active LED count, meaning the number of LEDs of the LED groups that are made to light on. The four following waveforms regard with currents $I_{G4}$, $I_{G3}$, $I_{G2}$ and $I_{G1}$, respectively flowing through LED groups $\mathbf{20}_4$, $\mathbf{20}_3$, $\mathbf{20}_2$ and $\mathbf{20}_1$. Active LED count rises or descends stepwise, following the increase or decrease of rectified voltage $V_{REC}$. When rectified voltage $V_{REC}$ increases, LED groups $\mathbf{20}_1$, $\mathbf{20}_2$, $\mathbf{20}_3$, and $\mathbf{20}_4$, according to a forward sequence, join to light on. When rectified voltage $V_{REC}$ decreases, LED groups $\mathbf{20}_1$, $\mathbf{20}_2$, $\mathbf{20}_3$, and $\mathbf{20}_4$, according to a backward sequence, darken.

AC LED circuits 15 and 30 both enjoy simple circuit architecture and, as can be derived, good power efficiency.

There in FIG. 3 however has dark zone $T_{DARK}$ when no LED activates or shines. If rectified voltage $V_{REC}$ is a 120 Hertz signal, voltage valley, where rectified voltage $V_{REC}$ is about zero Volt, appears as a 120 Herts signal, causing dark zone $T_{DARK}$ to appear in the same frequency of 120 Hertz. Even though dark zone $T_{DARK}$ of 120 Hertz might not be perceivable by human eyes, it is reported that human may feel dizzy or nauseated when looking, for a long period of time, objects exposed under the lighting with the non-perceivable dark zone $T_{DARK}$ of 120 Hertz.

SUMMARY

Embodiments of the present invention comprise a system with series-coupled light-emitting diodes, an integrated circuit, and an energy storage apparatus. The series-coupled light-emitting diodes are divided into several LED groups coupled in series. The integrated circuit comprises nodes respectively coupled to the LED groups, for providing a driving current to selectively flow through at least one of the LED groups. The energy storage apparatus has two ends coupled to a predetermined LED in a predetermined LED group. When the driving current flows through the predetermined LED group the energy storage apparatus energizes; and when the driving current does not flow through the predetermined LED group the energy storage apparatus de-energizes to illuminate the predetermined LED.

Embodiments of the present invention comprise a method for a system with series-coupled light-emitting diodes. The LEDs are divided into several LED groups coupled in series. A driving current is provided. One of the LED groups is selected, such that the driving current flows through a selected LED group. Electrical energy is stored when the driving current flows through a predetermined LED group. Stored electrical energy is released to light on a predetermined LED in the predetermined LED group when the driving current does not flow through the predetermined LED group.

BRIEF DESCRIPTION OF THE DRAWINGS

The invention can be more fully understood by the subsequent detailed description and examples with references made to the accompanying drawings, wherein.

DETAILED DESCRIPTION

Figure 4:
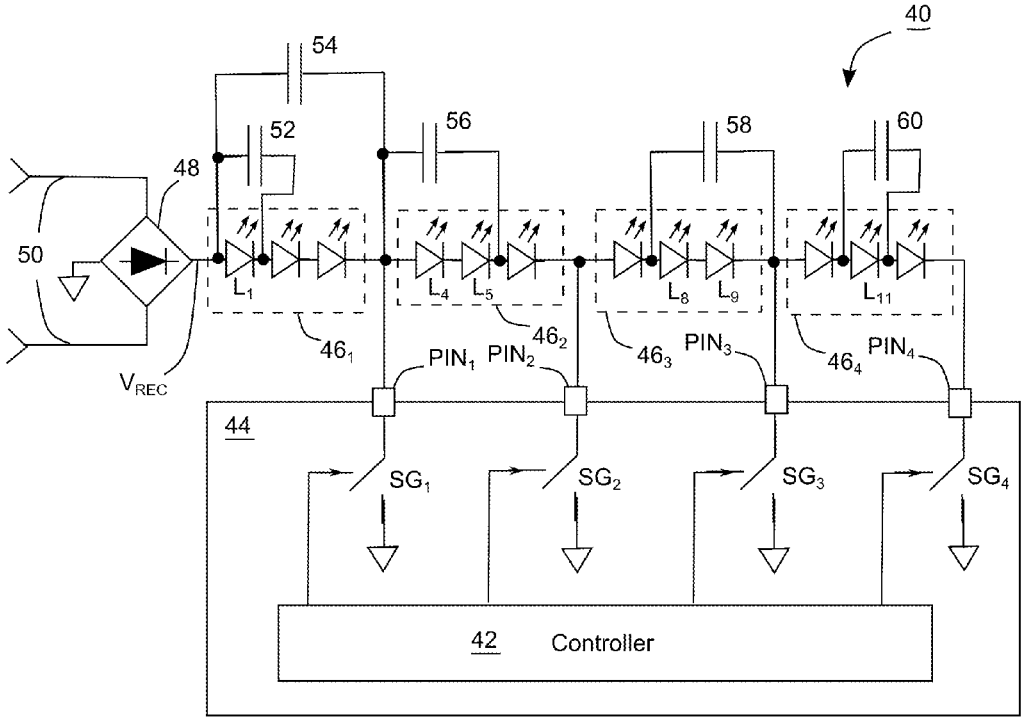
FIG. 4 shows a system with an AC LED circuit in accordance with an embodiment of the invention.

FIG. 4 shows a system with AC LED circuit 40 in accordance with an embodiment of the invention. A DC or AC voltage signal is received on input port 50. The AC voltage signal may be, for example, a 60 Hertz AC sinusoidal signal having a 110-volt amplitude. Full-wave rectifier 48 rectifies the voltage signal on input port 50 to provide a rectified voltage $V_{REC}$ and a ground voltage GND as two power supply lines to power the LEDs and integrated circuit 44 in FIG. 4. The LEDs are, but not limited to be, grouped into LED groups $\mathbf{46}_1$, $\mathbf{46}_2$, $\mathbf{46}_3$, and $\mathbf{46}_4$. As an illustrative example, each LED group in FIG. 4 has 3 LEDs coupled in series, and all LED groups are coupled in series to form a LED string.

FIG. 4 includes several capacitors 52, 54, 56, 58, and 60 to shunt with some LEDs respectively. The invention is not limited to FIG. 4, however. Other embodiments of the invention might have more or less capacitors, shunted to different LEDs. Capacitor 52 shunts with LED $L_1$, capacitor 54 the LED group $\mathbf{46}_1$, capacitor 56 the LED string consisting of LEDs $L_4$ and $L_5$, capacitor 58 the LED string consisting of LEDs $L_8$ and $L_9$, and capacitor 60 LED $L_{11}$. These capacitors act as energy storage apparatuses. They can charge or energize in some periods of time and later on discharge or de-energize to light on some LEDs.

Integrated circuit 44 has 4 nodes $PIN_1$, $PIN_2$, $PIN_3$, and $PIN_4$. Integrated circuit 44 further has ground switches $SG_1$, $SG_2$, $SG_3$ and $SG_4$, each coupled between a corresponding node and the ground voltage GND. Controller 42 in integrated circuit 44 controls the control terminals of ground switches $SG_1$, $SG_2$, $SG_3$ and $SG_4$. In one embodiment, controller 42 can sense the currents flowing through nodes $PIN_1$, $PIN_2$, $PIN_3$, and $PIN_4$, to determine the operation mode of each ground switch. For example, each ground switch can be individually switched to operate in one of three modes: including Open mode, Short mode, and constant current (CC) mode. Ground switch $SG_1$, for instance, shorts node $PIN_1$ to the ground voltage GND if operating in the Short mode; performs an open circuit if operating in the Open mode; and provides a constant driving current $I_{DRV}$ flowing through node $PIN_1$ to the ground voltage if operating in the CC mode.

For terminology, if devices A and B have similar circuit configurations but A has a work voltage higher than device B does, then device A is an upstream one in respect with device B. For example, ground switch $SG_1$ is an upstream one to ground switch $SG_2$ because the voltage at node $PIN_1$ is not less than that at node $PIN_2$. In the opposite, ground switch $SG_2$ is a downstream one to ground switch $SG_1$. The same terminology could be applied to other objects. For instance, LED group $\mathbf{46}_1$ is the most upstream LED group and LED group $\mathbf{46}_4$ the most downstream LED group in FIG. 4.

Figure 5A:
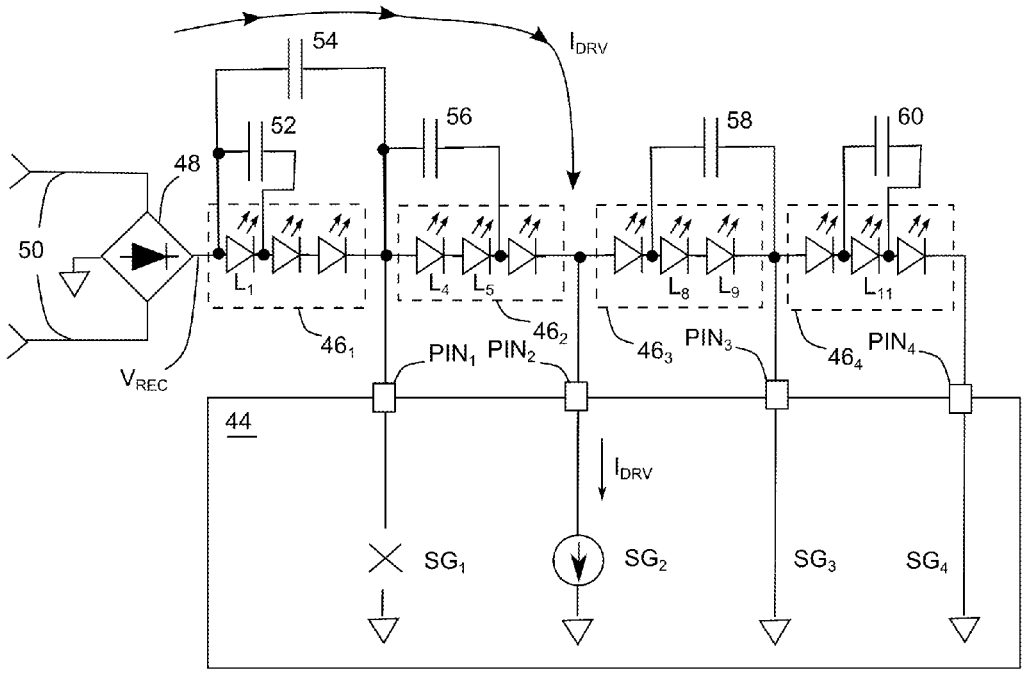
FIG. 5A shows that ground switches $SG_1$, $SG_2$, $SG_3$ and $SG_4$ operate in the Open, CC, Short, and Short modes, respectively.

In one embodiment, controller 42 is configured to select and have only one ground switch operating in the CC mode. Any ground switches upstream to the ground switch in the CC mode operate in the Open mode, and any ground switches downstream to the ground switch in the CC mode operate in the Short mode. FIG. 5A shows that ground switches $SG_1$, $SG_2$, $SG_3$ and $SG_4$ operate in the Open, CC, Short, and Short modes, respectively, in an occasion when rectified voltage $V_{REC}$ is high enough to conquer the forward threshold voltage of the LED string consisting of LED groups $\mathbf{46}_1$ and $\mathbf{46}_2$, but fails to further conquer the forward threshold voltage of LED group $\mathbf{46}_3$. It can be derived in FIG. 5A that driving current $I_{DRV}$ provided by ground switch $SG_2$ flows, in an steady state, through the LEDs in LED groups $\mathbf{46}_1$ and $\mathbf{46}_2$, and lights on the LEDs therein, while LED groups $\mathbf{46}_3$ and $\mathbf{46}_4$, through which no current flows, darken. In that steady state, capacitor 56 is charged to have a voltage drop of about the driving voltage for LEDs $L_4$ and $L_5$. Analogously, driving current $I_{DRV}$ charges capacitors 52 and 54 in the meantime to have their voltage drops about the driving voltages of LED $L_1$ and LED group $\mathbf{46}_1$, respectively.

Figure 5B:
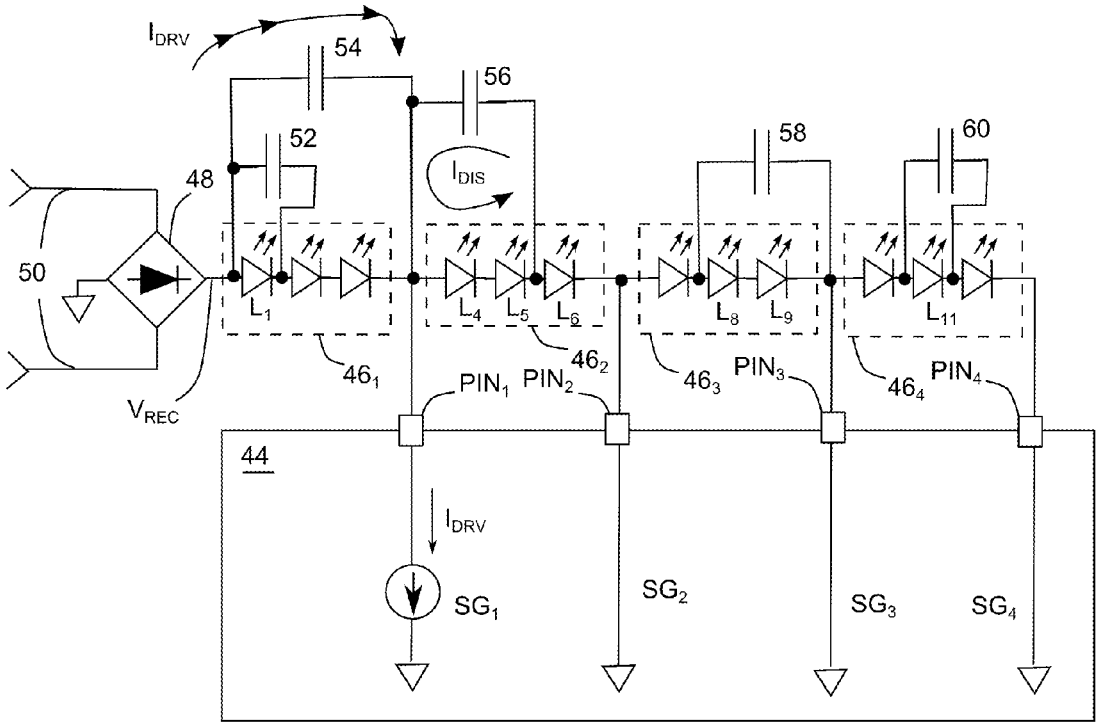
FIG. 5B shows the operation modes of ground switches $SG_1$, $SG_2$, $SG_3$ and $SG_4$ when rectified voltage $V_{REC}$ in FIG. 5A declines to a certain level.

Controller 42 of FIG. 4 might shift the CC mode to an adjacent ground switch if rectified voltage $V_{REC}$ varies. FIG. 5B shows the operation modes of ground switches $SG_1$, $SG_2$, $SG_3$ and $SG_4$ when rectified voltage $V_{REC}$ in FIG. 5A declines to a certain level and can no longer light on both LED groups $\mathbf{46}_1$ and $\mathbf{46}_2$. In comparison with the operation modes in FIG. 5A, controller 42 apparently shifts the CC mode from ground switch $SG_2$ to ground switch $SG_1$, such that all but ground switch $SG_1$ operate in the Short mode. After the shifting, driving current $I_{DRV}$ flows through the LEDs in LED group $\mathbf{46}_1$, but not those in LED groups $\mathbf{46}_2$, $\mathbf{46}_3$, and $\mathbf{46}_4$. Please note that, right after the shifting, capacitor 56 initially has the voltage drop capable of driving LEDs $L_4$ and $L_5$, and starts discharging to generate discharge current $I_{DIS}$ flowing through LEDs $L_4$ and $L_5$ as shown in FIG. 5B. Discharge current $I_{DIS}$ could have an amplitude significant to keep LEDs $L_4$ and $L_5$ illuminating for a while. The larger the capacitance of capacitor 56, the longer the LEDs $L_4$ and $L_5$ lasting to illuminate after the shifting.

Figure 1:
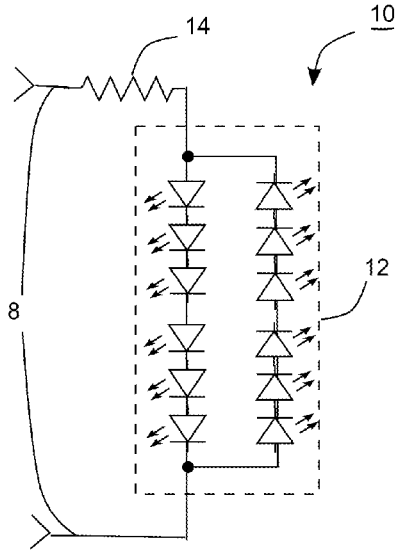
FIG. 1 (PRIOR ART)
FIGS. 1, 2A and 2B demonstrate three AC LED circuits in the art.
Figure 2A:
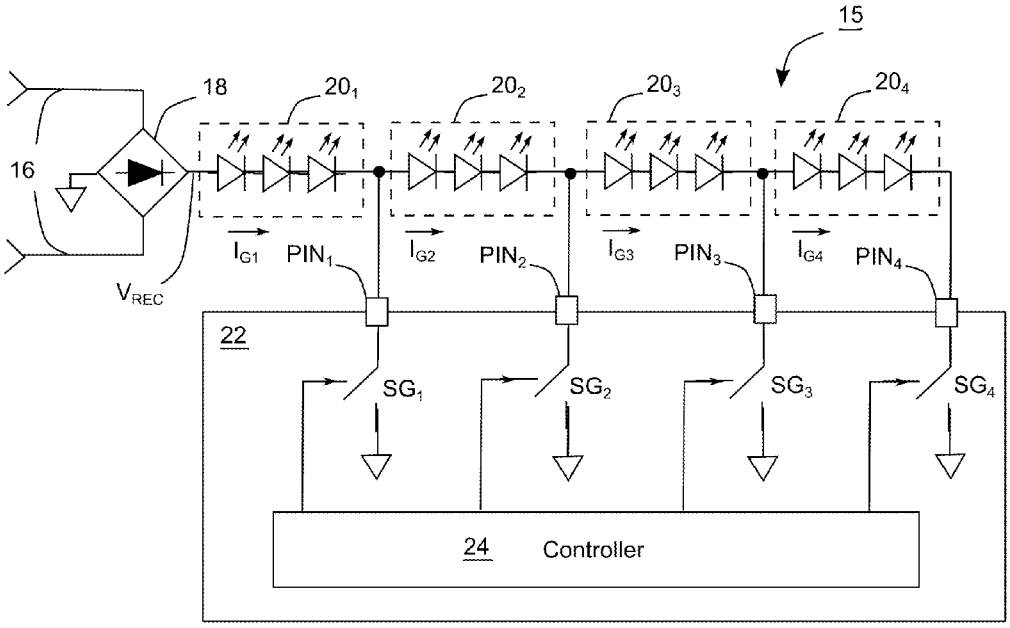
FIG. 2A (PRIOR ART)
Figure 2B:
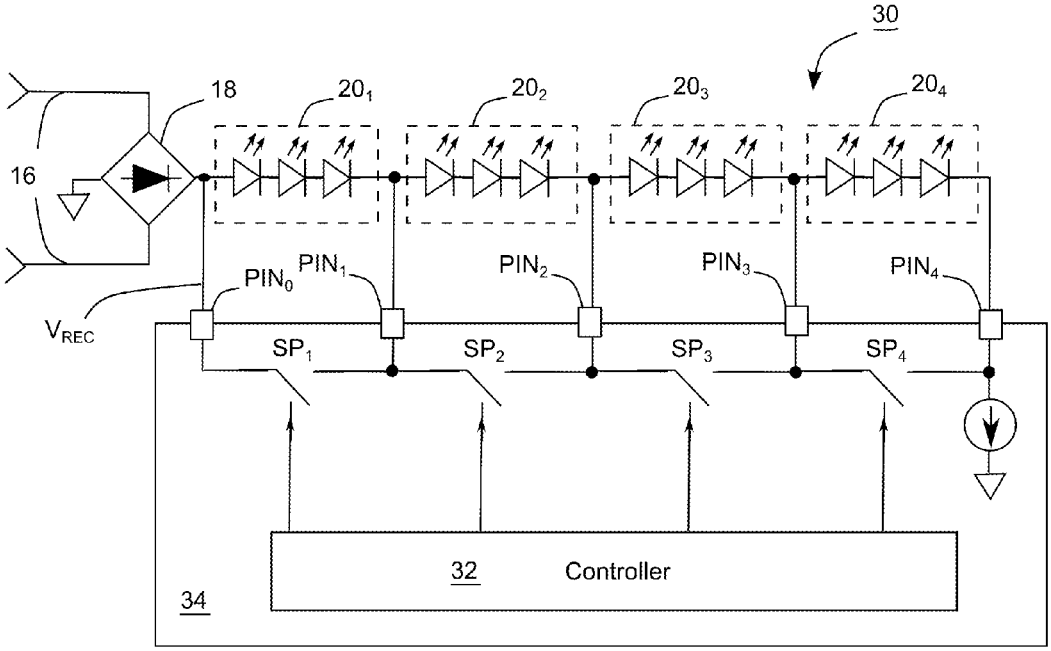
FIG. 2B (PRIOR ART)
Figure 3:
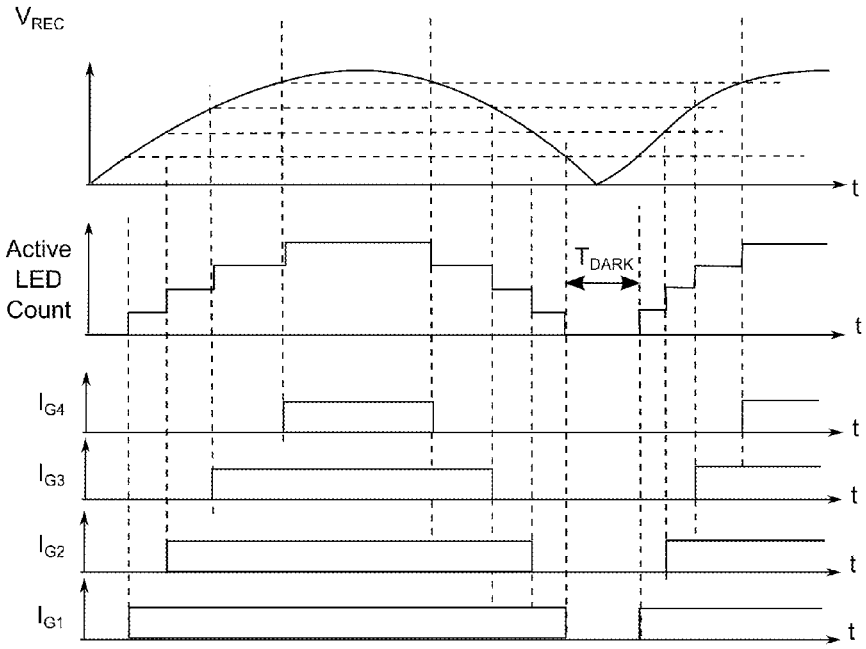
FIG. 3 (PRIOR ART)
FIG. 3 illustrates the waveforms of signals when the input port in FIG. 2A or 2B is supplied with an AC voltage signal.
Figure 6:
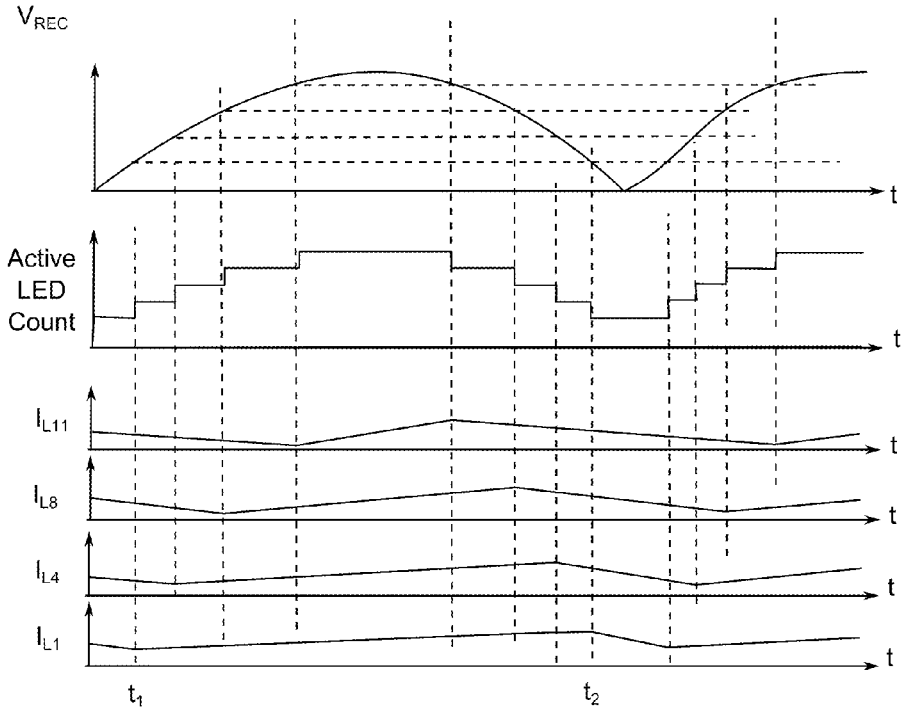
FIG. 6 illustrates the waveforms of signals when the input port in FIG. 4 is supplied with an AC voltage signal.

FIG. 6 illustrates the waveforms of signals when input port 50 in FIG. 4 is supplied with an AC voltage signal. The first waveform shows rectified voltage $V_{REC}$, and the second waveform shows active LED count. The rests show waveforms of currents $I_{L11}$, $I_{L8}$, $I_{L4}$, and $I_{L1}$, respectively flowing through LEDs $L_{11}$, $L_8$, $L_4$ and $L_1$. In comparison with FIG. 3, where the active LED count is zero during the dark zone $T_{DARK}$, the active LED count of FIG. 6 never falls to zero, such that dark zone $T_{DARK}$ disappears in FIG. 6. At time point $t_1$ when LED group $L_1$ starts to be driven by driving current $I_{DRV}$, for example, a portion of driving current $I_{DRV}$, referred to as charging current $I_{C52}$, goes to charge capacitor 52, and the rest of driving current $I_{DRV}$ flows through LED $L_1$ to be current $I_{L1}$. As time goes by from time point $t_1$ to $t_2$, capacitor 52 reaches or approaches saturation such that charging current $I_{C52}$ decreases and current $I_{L1}$ accordingly increases, as shown in FIG. 6. At time point $t_2$, driving current $I_{DRV}$ no longer drives LED group $L_1$, and capacitor 52 starts to discharge, providing current $I_{L1}$ to keep LED $L_1$ illuminating. Current $I_{L1}$ decreases as capacitor 52 loses the stored electrical energy therein. In FIG. 6, the tilted portions in the waveform of the currents $I_{L11}$, $I_{L8}$, $I_{L4}$, and $I_{L1}$ are all caused by the existence of the shunt capacitors in FIG. 4. If the shunt capacitor 52 or 54 has capacitance so large that at least one LED in LED group $\mathbf{46}_1$ can keep on illuminating over the voltage valleys where rectified voltage is about 0 Volt, there could be at least one LED illuminating all the time. In other words, dark zone $T_{DARK}$, which is demonstrated in FIG. 3 and causes human dizzy and nauseated, can be eliminated by embodiments of the invention, as exemplified in FIG. 6. For example, if the capacitance of capacitor 52 in FIG. 4 is very large, LED $L_1$ might continuously illuminate, driven by either the driving current $I_{DRV}$ from the ground switches or the discharge current $I_{DIS}$ from capacitor 52. In this embodiment, integrated circuit 44 is configured such that LED group $\mathbf{46}_1$ is the priority one to light on when rectified voltage $V_{REC}$ increases and also the last one to darken when rectified voltage $V_{REC}$ decreases.

LEDs are designed for illuminating or lighting when being forward-bias driven and that is why semiconductor process engineers in LED manufactures devote their efforts in forward-bias operations for LEDs. Nevertheless, LEDs might be vulnerable to reverse-bias operations even though LEDs ought to function as rectifiers. Accordingly, it is better for circuit designers to avoid LEDs from reverse-bias operations. Please refer back to FIG. 5B. When capacitor 56 discharges or de-energizes to illuminate LEDs $L_4$ and $L_5$, it is possible for LED $L_6$ to experience reverse-bias voltage and be damaged.

Figure 7:
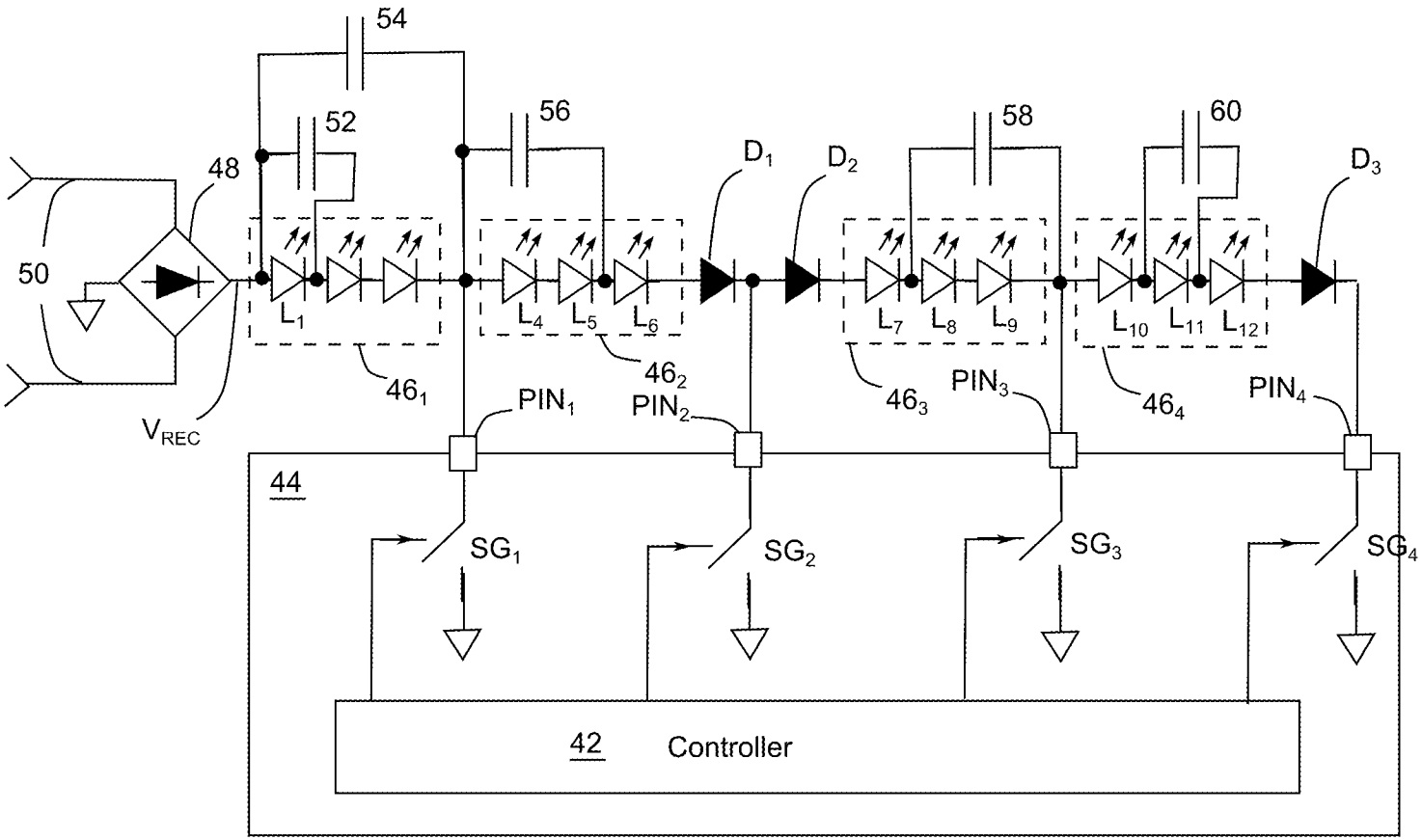
FIG. 7 employs some additional regular diodes to sustain reverse-bias voltages, preventing LEDs from being damaged.

FIG. 7 employs some additional regular diodes to sustain reverse-bias voltages, preventing LEDs from being damaged. Different from the AC LED circuit 40 in FIG. 4, FIG. 7 has regular diode $D_1$, $D_2$ and $D_3$. $D_1$ is connected between LED group $\mathbf{46}_2$ and node $PIN_2$, regular diode $D_2$ is between node $PIN_2$ and LED group $\mathbf{46}_3$, and regular diode $D_3$ is between LED groups $\mathbf{46}_4$ and node $PIN_4$. Here in this specification, a regular diode means a rectifier which is not an LED, and stands for reverse-bias voltage better than a LED does. For example, a regular diode could be a Schottky barrier diode, which requires a low forward-bias voltage to turn on. When capacitor 56 of FIG. 7 discharges or de-energizes to illuminate LEDs $L_4$ and $L_5$, the anode of LED $L_5$ might have a negative voltage and node $PIN_2$ be grounded. Most of this negative voltage drops across regular diode $D_1$ since it can sustain a reverse-bias voltage operation. LED $L_6$ accordingly experiences little or no reverse-bias voltage, and is protected by regular diode $D_1$. Analogously, regular diode $D_2$ can protect LED $L_7$ from being damaged by a reverse-bias voltage, and regular diode $D_3$ can protect LEDs $L_{10}$ and $L_{12}$.

Figure 8:
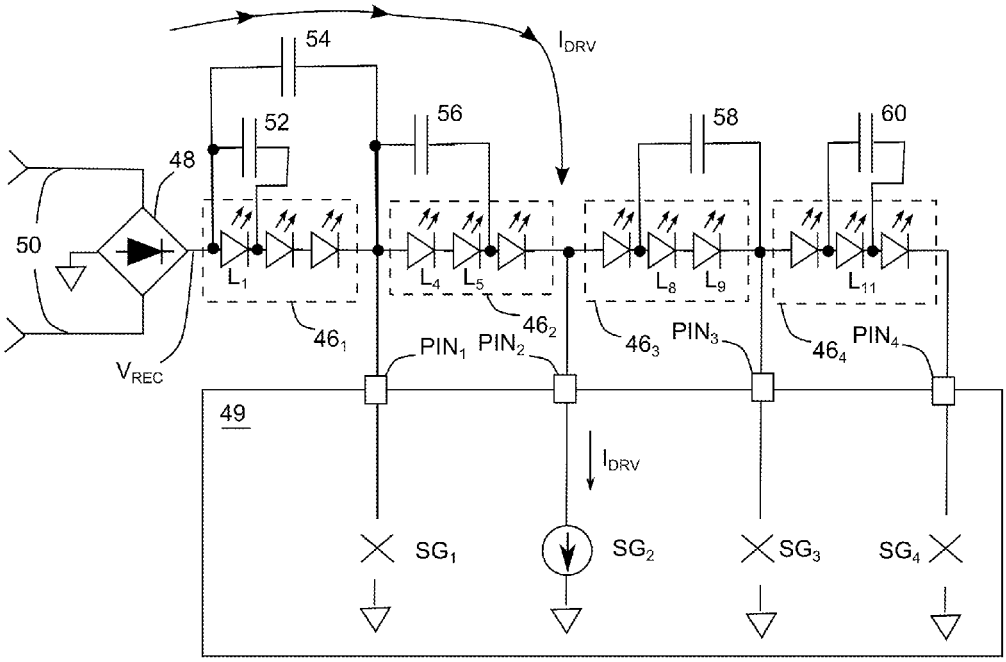
FIG. 8 shows only one ground switch operating in the CC mode and all other ground switches operating in the Open mode.

Please refer back to FIG. 5B again. One reason for the occurrence of the reverse-bias voltage on LED $L_6$ is node $PIN_2$ shorted to the ground voltage GND when capacitor 56 de-energizes. Unlike integrated circuit 44 did in FIG. 5B, integrated circuit 49 in FIG. 8 has only one ground switch operating in the CC mode and all other ground switches operating in the Open mode. As shown in FIG. 8, for a certain magnitude of rectified voltage $V_{REC}$, only ground switch $SG_2$ works in the CC mode, providing constant driving current $I_{DRV}$. All ground switches but ground switch $SG_2$ perform as an open circuit. Integrated circuit 49 in FIG. 8 could shift the CC mode to an adjacent ground switch as well, when rectified voltage $V_{REC}$ varies. For another magnitude of rectified voltage $V_{REC}$, ground switch $SG_1$ might operate in the CC mode while others operate in the Open mode. Accordingly, in the time when capacitor 56 de-energizes to illuminate LED $L_4$ and $L_5$, node $PIN_2$ is floating, and LED $L_6$ no more experiences a reverse-bias voltage.

Figure 9A:
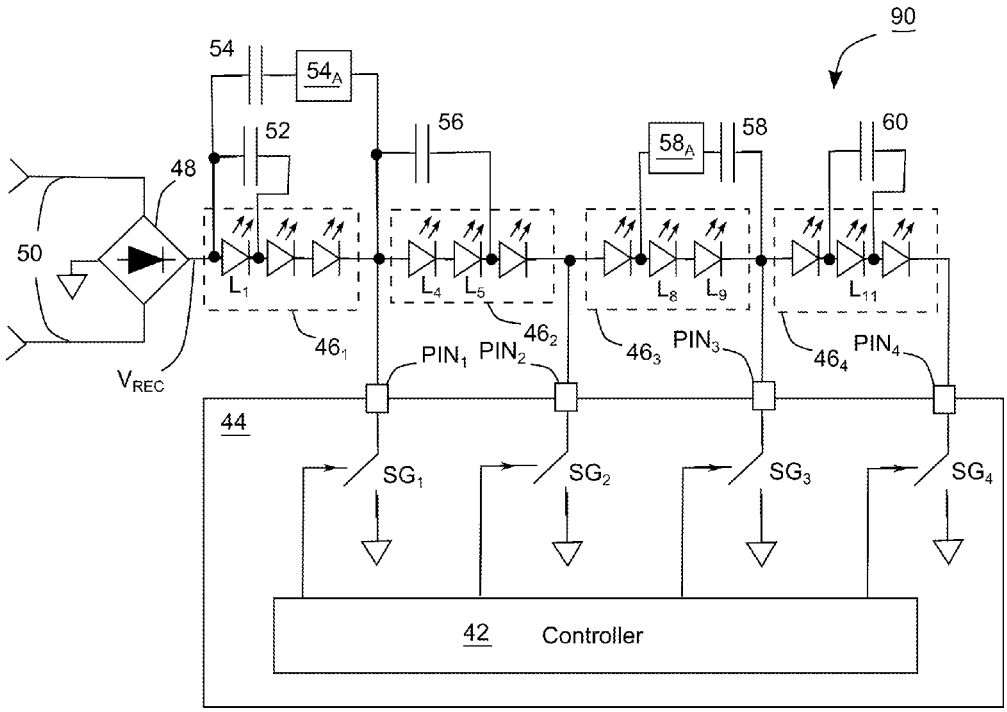
FIG. 9A shows another system with an AC LED circuit.
Figure 9B:
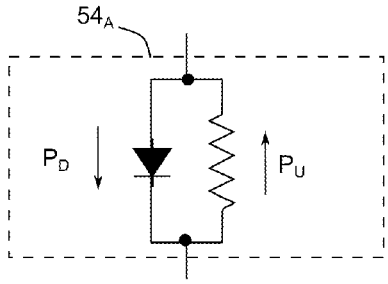
FIG. 9B demonstrates an embodiment of the charge/discharge controller in FIG. 9A.

The charging and discharging speeds of a capacitor might be different. FIG. 9A shows another system with AC LED circuit 90. Some devices in FIG. 9A have been described in previous paragraphs and will not be redundantly detailed. Charge/discharge controller $\mathbf{54}_A$ is demonstratively connected between capacitor 54 and node $PIN_1$ and charge/discharge controller $\mathbf{58}_A$ is between capacitor 58 and LED $L_8$. Taking charge/discharge controller $\mathbf{54}_A$ as an example, charge/discharge controller $\mathbf{54}_A$ is connected in series with capacitor 54 and can provide different conductivities for charging and discharging capacitor 54. FIG. 9B demonstrates an embodiment of charge/discharge controller $\mathbf{54}_A$, comprising a resistor and a diode connected in parallel. If the diode is forward biased, current will flow through path $P_D$, which has relatively-high conductivity. In the opposite, if the diode is reverse biased, current will flow through path $P_U$ with relatively-low conductivity. To shorten or eliminate a dark zone, capacitor 54 connected in series with charge/discharge controller $\mathbf{54}_A$ is preferably charged quicker but discharged slower. FIG. 9B is not intended to limit the scope of the invention, however. A charge/discharge controller in another embodiment of the invention has, for example, a sensor and an active device. The active device is connected in series with capacitor 54. The sensor detects whether capacitor 54 energizes or de-energizes and accordingly controls a control node of the active device, such that charging and discharging rates are different. The active device could be a BJT or MOS transistor, for example.

Figure 10:
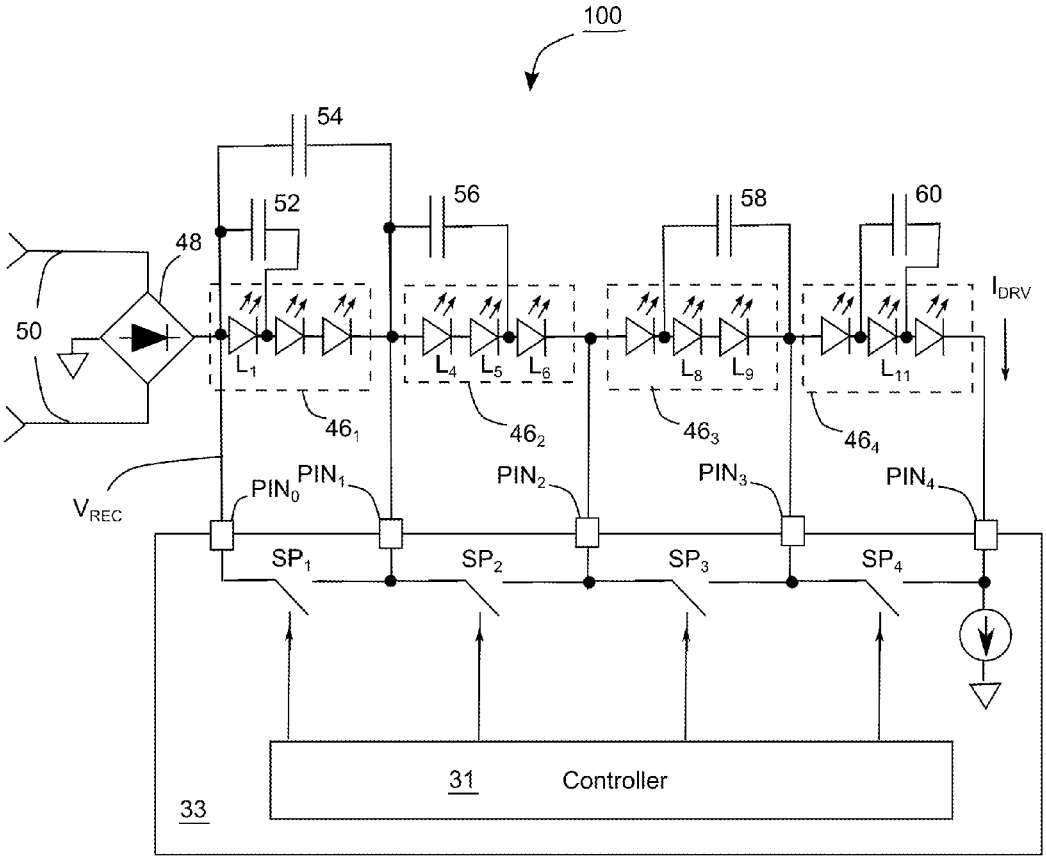
FIG. 10 shows a system with another AC LED circuit 100 in accordance with an embodiment of the invention.

Although the previous embodiments are all implemented with an integrated circuit having ground switches, this invention is not limited to. FIG. 10 shows a system with AC LED circuit 100 in accordance with an embodiment of the invention. FIG. 10 is almost the same with FIG. 4, but integrated circuit 44 in FIG. 4 is replaced by integrated circuit 33 in FIG. 10. Controller 31 can turn on or off bypass switches $SP_1$, $SP_2$, $SP_3$ and $SP_4$, individually. In a moment, controller 31 might make bypass switches $SP_1$ and $SP_3$ short and bypass switches $SP_2$ and $SP_4$ open, so that driving current $I_{DRV}$ flows through only LED groups $\mathbf{46}_2$ and $\mathbf{46}_4$. In other words, controller 31 could illuminate an LED group by making a corresponding bypass switch an open circuit, or darken the LED group by making the corresponding bypass switch a short circuit. If bypass switches $SP_2$ acts as an open circuit, LED group $\mathbf{46}_2$ is selected to illuminate, and capacitor 56 energizes. When bypass switches $SP_2$ acts as a short circuit, LED group $\mathbf{46}_2$ is unselected, LED $L_6$ darkens, and capacitor 56 de-energizes to temporarily illuminate LEDs $L_4$ and $L_5$. Accordingly, capacitor 56 could last the illumination of LEDs $L_4$ and $L_5$.

According to the embodiment, capacitors shunted with LEDs can last the illumination of the LEDs, and probably shorten or eliminate the dark zone, which could cause dizziness or nausea in the art.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system, comprising:

series-coupled light-emitting diodes, divided into several LED groups coupled in series;

an integrated circuit, comprising nodes respectively coupled to the LED groups, for providing a driving current to selectively flow through at least one of the LED groups; and an energy storage apparatus, having two ends coupled to a predetermined LED in a predetermined LED group, wherein when the driving current flows through the predetermined LED group the energy storage apparatus energizes, and when the driving current does not flow through the predetermined LED group the energy storage apparatus de-energizes to illuminate the predetermined LED.

2. The system as claimed in claim 1, wherein the integrated circuit is configured such that the predetermined LED group is the priority one to light on when a power supply voltage powering the LEDs increases.

3. The system as claimed in claim 1, wherein the integrated circuit is configured such that the predetermined LED group is the last one to darken when a power supply voltage powering the LEDs decreases.

4. The system as claimed in claim 1, wherein the energy storage apparatus comprises a capacitor.

5. The system as claimed in claim 4, wherein the energy storage apparatus further comprises a charging/discharge controller with different conductivities for charging and discharge the capacitor, respectively.

6. The system as claimed in claim 5, wherein the charging/discharge controller comprises a diode.

7. The system as claimed in claim 6, wherein the charging/discharge controller further comprises a resistor connected in parallel with the diode.

8. The system as claimed in claim 5, wherein the charging/discharge controller comprises an active device coupled in series with the capacitor.

9. The system as claimed in claim 8, wherein the active device is a BJT or MOS transistor.

10. The system as claimed in claim 1, wherein the integrated circuit comprises ground switches, each optionally shorting a corresponding LED group to a ground voltage.

11. The system as claimed in claim 10, wherein the ground switches are coupled via the nodes to the LED groups respectively, and when a selected ground switch provides the driving current to a selected LED group, an upstream ground switch coupled to an upstream LED group performs an open circuit and a downstream ground switch coupled to a downstream LED group performs a short circuit.

12. The system as claimed in claim 10, wherein the ground switches are coupled via the nodes to the LED groups respectively, and when a selected ground switch provides the driving current to a selected LED group, an upstream ground switch coupled to an upstream LED group performs an open circuit and a downstream ground switch coupled to a downstream LED group performs an open circuit.

13. The system as claimed in claim 1, wherein the integrated circuit comprises bypass switches, each optionally making the driving current bypass an unselected LED group.

14. The system as claimed in claim 1, further comprising:

a rectifier, coupled between the predetermined LED group and another LED group, wherein when the energy storage apparatus de-energizes, the rectifier prevents the LEDs in the predetermined LED group from reverse-bias voltage, and the rectifier is not an LED.

15. A method for a system with series-coupled light-emitting diodes, wherein the LEDs are divided into several LED groups coupled in series, the method comprising:

providing a driving current;

selecting one of the LED groups, such that the driving current flows through a selected LED group;

storing electrical energy when the driving current flows through a predetermined LED group; and releasing stored electrical energy to light on a predetermined LED in the predetermined LED group when the driving current does not flow through the predetermined LED group.

16. The method as claimed in claim 15, further comprising:

making the predetermined LED group the priority one to light on when a power supply voltage powering the LEDs increases.

17. The method as claimed in claim 15, further comprising:

making the predetermined LED group the last one to darken when a power supply voltage powering the LEDs decreases.

18. The method as claimed in claim 15, further comprising:

providing ground switches, each optionally shorting a corresponding LED group to a ground voltage.

19. The method as claimed in claim 15, further comprising:

providing bypass switches, each optionally making the driving current bypass an unselected LED group.

20. The method as claimed in claim 15, further comprising:

providing different conductivities for storing the electrical energy and releasing the stored electrical energy, respectively.

* * * * *